United States Patent [19]

Hillis

[11] Patent Number: 4,773,873

[45] Date of Patent: Sep. 27, 1988

[54] BISTABLE ZERO INSERTION FORCE CONNECTOR

[75] Inventor: W. Daniel Hillis, Brookline, Mass.

[73] Assignee: Thinking Machines Corporation, Cambridge, Mass.

[21] Appl. No.: 914,051

[22] Filed: Oct. 1, 1986

[51] Int. Cl.[4] ..... H01R 13/62

[52] U.S. Cl. ..... 439/260; 439/259; 439/266; 439/267

[58] Field of Search ..... 339/75 R, 74 R, 75 M, 339/75 MP; 439/259–270

[56] References Cited

U.S. PATENT DOCUMENTS

| | | | |
|---|---|---|---|
| Re. 29,223 | 8/1975 | Pritulsky | 339/75 |
| 3,188,598 | 6/1965 | Pferd | 339/75 MP |
| 3,518,612 | 6/1970 | Dunman et al. | 339/74 R |
| 4,139,937 | 2/1979 | L'Homme | 29/235 |
| 4,266,339 | 5/1981 | Aikens | 339/75 MP |
| 4,327,955 | 5/1982 | Minter | 339/75 MP |
| 4,448,466 | 5/1984 | Porter | 339/176 MP |
| 4,503,609 | 3/1985 | Mackay | 29/843 |
| 4,518,210 | 5/1985 | Morrison | 339/75 |
| 4,533,189 | 8/1985 | Scoccia et al. | 339/17 CF |
| 4,560,222 | 12/1985 | Dambach | 339/75 |
| 4,575,172 | 3/1986 | Walse et al. | 339/75 |
| 4,580,192 | 4/1986 | Beun | 361/395 |
| 4,585,288 | 4/1986 | Aikens | 339/75 |
| 4,597,619 | 7/1986 | Reimer | 339/75 MP |

OTHER PUBLICATIONS

Design News/2/3/86, Sockets Permit Low- or Zero--Force Module Insertion.

*Primary Examiner*—J. Patrick McQuade

*Attorney, Agent, or Firm*—Weingarten, Schurgin, Gagnebin & Hayes

[57] ABSTRACT

A bistable zero insertion force connector assembly including one or more conductive contact members. Each conductive contact member includes mating ends or contact arms having contact surfaces and a resilient central segment. Variable engagement means cooperates with each conductive contact member to displace the member from a first stable state to a second stable state and vice versa, with minimal force the member being maintained in the first or second stable states by means of stresses induced in the resilient central segment. In the first stable state the contact surfaces of the mating ends or contact arms are disposed in mating proximity to the contact surfaces of the device to be electrically connected therewith with zero force/zero contact while in the second stable state there is secured engagement between the respective contact surfaces. Wiping contact between the respective contact surfaces during transition between the first and second stable states enhance reliability of the electrical connection.

38 Claims, 7 Drawing Sheets

FIG.1A
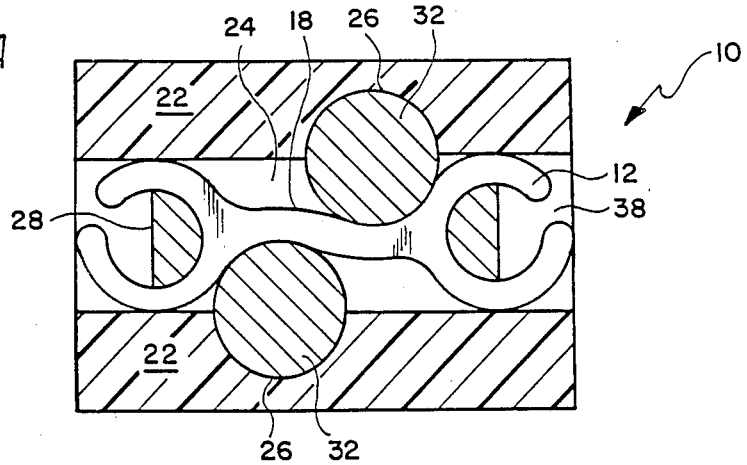
FIG.1B
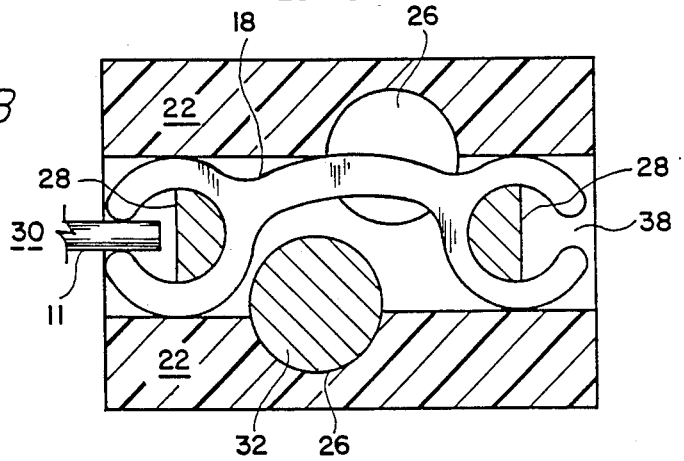
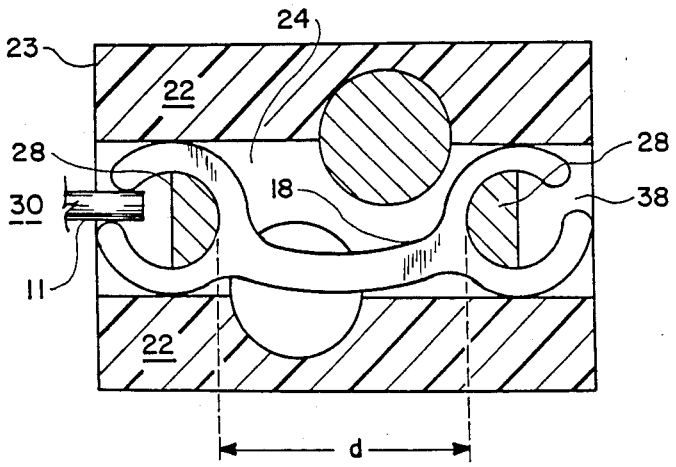
FIG.1C

FIG. 2A
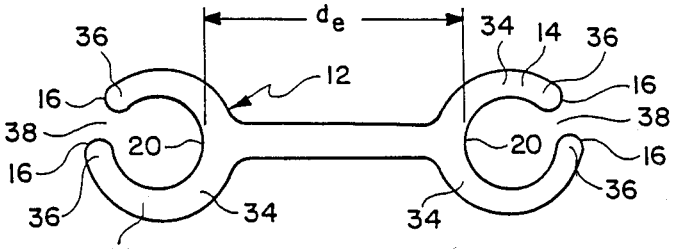
FIG. 2B
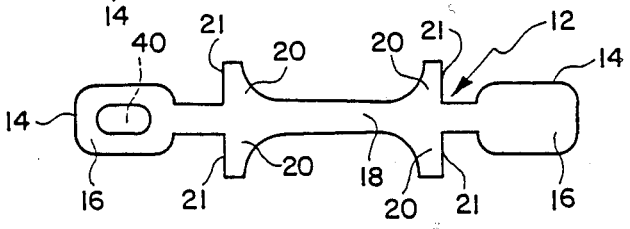
FIG. 2C
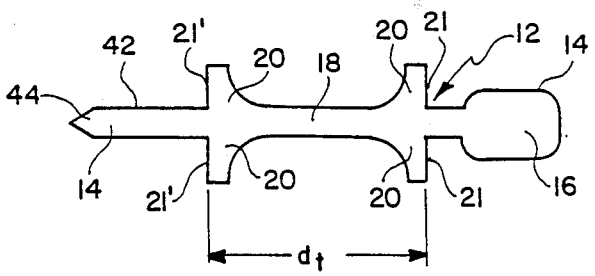
FIG. 3A
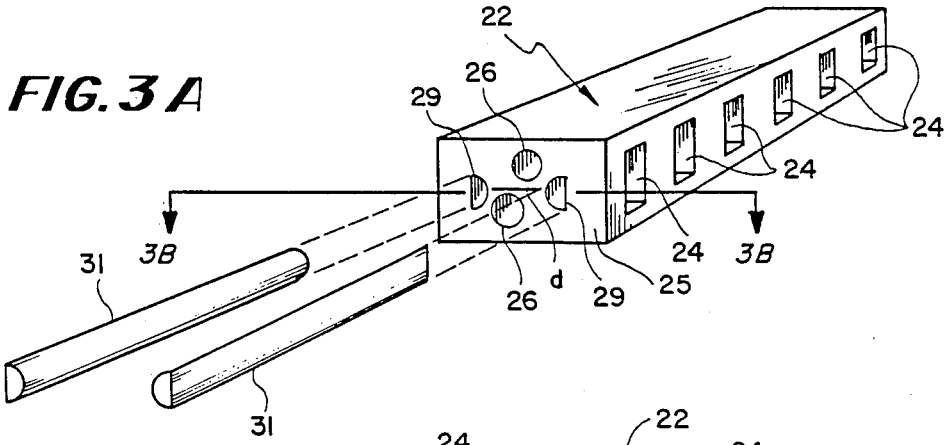
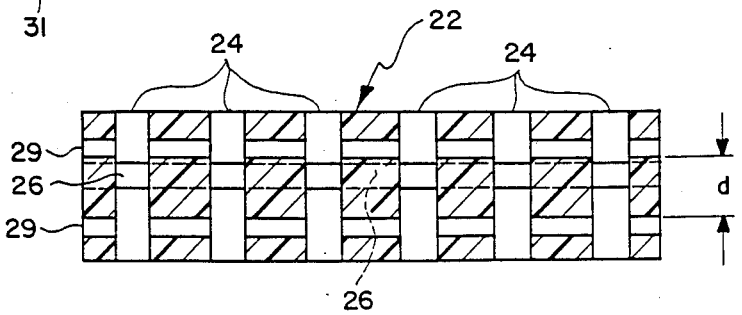
FIG. 3B

BISTABLE ZERO INSERTION FORCE CONNECTOR

BACKGROUND OF THE INVENTION

1. Field of the Invention

This invention relates generally to electrical connectors, and more particularly to a bistable zero insertion force connector assembly wherein the mating ends of conductive contact elements in the first stable or unengaged state are placeable in mating proximity to terminal connecting elements with zero force and zero contact therebetween, while in the second stable or engaged state the mating ends and corresponding terminal connecting elements are maintained in secured engagement.

2. Prior Art

The advent of the parallel processing concept wherein several processors or microprocessors are electrically interconnected to several memory, control, input/output, and auxiliary units has necessitated that vast arrays of PC boards, circuit cards, banks of terminal connectors and the like be electrically integrated. To facilitate such integration it is advantageous to mass engage one or more such arrays to connector assemblies in a single operation with a minimal force.

And, with the increasing tendency towards miniaturization and high-density packing of PC boards, circuit cards, and terminal connector banks, the number of contact points per array is substantially increased, thereby multiplying the force necessary to mass engage such arrays to connector assemblies to the point where it is very difficult from a physical force standpoint to make such connections. Further complicating the electrical integration of such arrays is the fragility of the contact points of the arrays and the electronic devices or components to be integrated thereto, such that alignment of such arrays with connector assemblies for mass engagement must be accomplished with minimal force therebetween to allow insertion and to preclude damage to the contact points and/or the electronic elements of the assemblies. Any such damage will result in incomplete electrical connection or circuit failure.

Zero insertion force (ZIF) connector assemblies are well known in the prior art. Representative examples of such ZIF connector assemblies include U.S. Pat. Nos. 4,576,427, Re. 31,929, 4,332,431, and 4,266,840. Generally, such ZIF connector assemblies comprise complex contact elements, assembly housings, and/or actuation or mass engagement means that allow male and female connector pairs to be inserted and subsequently engaged. The complexity of such ZIF connector assemblies increases the costs thereof, in manufacturing the elements thereof, in preloading or inserting the connector elements within the assembly housing, and in the time consumed in preloading, and lowers the overall reliability. Moreover, the complexity of such ZIF connector assemblies makes them less readily adaptable for miniaturization or high density packing. These factors militate against the use of such ZIF connector assemblies where numerous arrays must be electrically integrated.

A further problem is inherent in the use of prior art ZIF connector assemblies where numerous arrays must be electrically integrated. Although ZIF connector assemblies permit large arrays to be disposed in mating proximity thereto with zero force, the physical force necessary to accomplish engagement therebetween becomes prohibitively large as the number of contact points increases. Thus, miniaturization is limited by the resulting increase in connection force, be it throught insertion or engagement.

SUMMARY OF THE INVENTION

The present invention surmounts the inherent disadvantages of the prior art by providing a bistable ZIF connector assembly adapted for electrical integration with vast arrays wherein the arrays and bistable ZIF connector assembly are placed in mating proximity with zero force and substantially zero contact therebetween. Mass engagement therebetween is effected by a minimal force by sequential contact engagement, and the subsequently engaged contacts are maintained in secured engagement, both electrically and physically. By sequential contact engagement the instantaneous contact engagement force is very low, being distributed over time.

In one embodiment the bistable ZIF connector assembly comprises an insulated housing having preloaded therein one or more conductive contact members in a stressed condition in either a first or second stable state. In the first stable state first and second contact surfaces of each mating end of the conductive contact members are maintained such that contact points of an array can be placed in mating proximity thereto with zero force and substantially zero contact therebetween. A mass engagement means cooperates with one of two actuation means of the insulated housing to effect mass engagement with a minimal engagement force. Mass engagement of the conductive contact members are in the second stable state wherein the first and second contact surfaces of each mating end exert substantially normal forces against the contact points of the arrays to maintain secure engagement, both electrically and physically. During the transition from the first stable state to the second, the contact surfaces of each mating end provide an advantageous wiping action on the contact points of the arrays.

Each conductive contact member further includes a resilient central segment and carrier engaging means. The carrier engaging means cooperates with an interaction means disposed in the channel housing the conductive contact member to maintain the resilient central segment in a stressed condition in the first and second stable states. The stressed resilient central segment causes the first and second mating surfaces to be maintained for zero force/zero contact insertion of the contact points of the arrays in the first stable state and to exert engaging forces against the contact points/elements of the arrays in the second stable state.

Accordingly, it is a primary object of the present invention to provide a simple and inexpensive bistable zero insertion force connector assembly for electrically integrating vast arrays.

Another object of the present invention is to provide a bistable zero insertion force connector assembly which is positionable for mass engagement with the contact points/elements of the arrays with zero force and substantially zero contact therebetween.

Still another object of the present invention is to provide a bistable zero insertion force connector assembly which is mass engageable with a minimal instantaneous force.

Yet another object of the present invention is to provide a bistable zero insertion force connector assembly wherein conductive contact members disposed in the assembly housing are maintained in either a first or second stable state.

Still one more object of the present invention is to provide a mass engagement means which cooperates with the bistable zero insertion force connector assembly, and wherein the mass engagement means provides a wiping action between contacts during engagement.

BRIEF DESCRIPTION OF THE DRAWINGS

A more complete understanding of the present invention and the attendant advantages and features thereof will be more readily appreciated as the same becomes better understood by reference to the following detailed description when considered in conjunction with the accompanying drawings wherein:

FIG. 1A is an axial cross-sectional view of a bistable zero insertion force connector assembly depicting a conductive contact member partially preloaded in a channel of the assembly housing;

FIG. 1B is an axial cross-sectional view showing a preloaded conductive contact member in a first stable state;

FIG. 1C is an axial cross-sectional view illustrating a preloaded conductive contact member in a second stable state;

FIG. 2A is a side view of a conductive contact member having C-shaped mating ends;

FIG. 2B is a top/bottom view of a conductive contact member having first and second generally rectangular, flat mating ends;

FIG. 2C is a top/bottom view of a conductive contact member having one generally rectangular, flat mating end and a second mating end having an elongated portion with tapered end;

FIG. 3A is an external perspective view of an insulated assembly housing for conductive contact members of FIG. 2A;

FIG. 3B is a cross-sectional view of the insulated housing of FIG. 3A taken along line 3B—3B;

DETAILED DESCRIPTION OF PREFERRED EMBODIMENTS

Figure 4A:
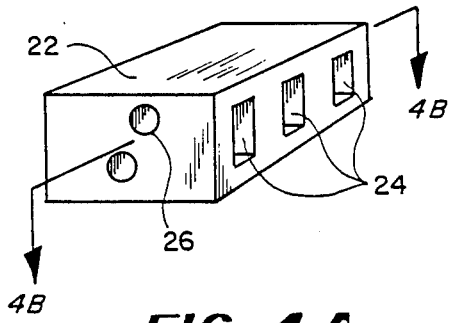
FIG. 4A is an external perspective view of an insulated assembly housing for conductive contact members of FIGS. 2B or 2C.

Referring now to the drawings, wherein like reference numerals designate similar or corresponding elements throughout the several views, there is shown generally in FIGS. 1A, 1B, 1C, 4B and 4C a bistable zero insertion face (ZIF) connector assembly 10 according to the present invention. The bistable ZIF connector assembly 10 comprises one or more conductive contact member(s) 12 disposed within an insulated housing 22.

The configuration and operation of the conductive contact member 12 may be better understood by referring to FIGS. 2A, 2B, and 2C and the ensuing description. FIGS. 2A, 2B, and 2C depict different embodiments of the conductive contact member 12 according to the present invention, but it is to be understood that these depictions are representative only, and not intended to limit in any way the scope of the present invention. The conductive contact member 12 includes first and second mating ends 14, at least one of the mating ends 14 including first and second contact surfaces 16 adapted for bistable connection to a terminal connecting element 11 of an electronic device 30 such as a PC board or a circuit card, a resilient central segment 18, and carrier or device engaging means 20.

One embodiment of the conductive contact member 12 is depicted in FIG. 2A, wherein the first and second mating ends 14 have a C-shaped configuration. A pair of arcuate arms 34 extend integrally from each exterior axial portion of the resilient central segment 18 to form the first and second C-shaped mating ends 14. Ends 36 of each pair of arcuate arms 34 terminate in a spaced apart relationship to define an opening 38. The surfaces of the terminated ends 36 of each pair of arcuate arms 34 in an opposed facing relationship with respect to the opening 38 constitute the first and second contact surfaces 16 of each C-shaped mating end 14. Thus, in this embodiment both mating ends 14 are adapted for bistable connection.

Each pair of arcuate arms 34 further defines an arcuate surface segment which is substantially symmetrical about a longitudinal axis of the resilient central segment 18 and is disposed in a facing relationship with the opening 38. For this particular embodiment, the arcuate surface segments of the C-shaped mating ends 14 function as the carrier engaging means 20, in a manner to be described below.

The conductive contact member 12 having C-shaped mating ends 14 is fabricated in such manner that the arcuate arms 34 of each mating end 14 act to vary the spacing between the ends 36 thereof, that is, the size of the opening 38 in the horizontal plane is variable. Prior to preloading the conductive contact member 12 into the housing 22, the ends 36 define an intermediate opening, as shown in FIG. 2A. A preloaded conductive contact member 12 in a first stable or unengaged state, as shown in FIG. 1B, has the resilient central segment 18 in a stressed condition, this stressed condition causing each pair of arcuate arms 34 to rotate the ends 36 thereof into an alignment readily accepting the element 11 of device 30. Thus, in the first stable state an electrical/electronic device 30 such as a PC board or circuit card may be inserted into the unengaged opening 38 with zero force and substantially zero contact. The terminal elements 11 of such device 30, such as conducting strips or contact points may then be aligned with the first and second contact surfaces 16 of the mating end 14 with no contact therebetween.

When the conductive contact member 12 is displaced to a second stable or engaged state, the stressed condition of the resilient central segment 18 causes each pair of arcuate arms 34 to rotate the ends 36 thereof to form a skewed or engaged opening 38. As the ends 36 transition from the first stable state to the second stable state, the contact surfaces 16 thereof wipingly engage the contact surfaces of the terminal element 11.

The embodiment of FIG. 2B shows a conductive contact member 12 wherein both the first and second mating ends 14 are adapted for bistable connection. Each mating end 14 is generally rectangular in shape, and flat, in effect forming a thin plate. It is to be understood that the mating ends 14 of this embodiment may be formed in other geometric configurations, such as ovoid or square, within the scope of the present invention. The upper and lower surfaces of each such mating end 14 are substantially parallel to each other and comprise the first and second contact surfaces 16. The first and second surfaces 16 of the generally rectangular, flat mating ends 14 may be selectively plated, shown representatively as oval area 40 in FIG. 2B, with a good conducting material such as gold, to further enhance electrical contact when the first and second contact surfaces 16 are engaged with the terminal connecting element 11 of an electrical/electronic device 30. The carrier engaging means 20 comprise dual pairs of tabs 20 as shown in FIGS. 2B and 2C. The tabs 20 of each pair are in diametrically opposed relationship about the longitudinal axis of the resilient central segment 18.

The conductive contact member 12 depicted in FIG. 2C is as described for the embodiment illustrated in FIG. 2B, except that only one mating end 14 is adapted for bistable connection. The other or non-adapted mating end 14, by way of illustration, comprises an elongated section 42 having a free tapered end 44, the elongated section 42 and free tapered end 44 having a longitudinal axis coaxial with the longitudinal axis of the resilient central segment 18.

The conductive contact member 12 of the above-described embodiments of FIGS. 2A, 2B and 2C are readily and inexpensively fabricated by stamping from a flat piece of conductive metal.

An insulated housing 22 compatible with the conductive contact member 12 of FIG. 2A is shown in FIGS. 1A, 1B, 1C, 3A and 3B. The housing 22 has a plurality of channels 24 formed therethrough transversely to the longitudinal dimension thereof. The overall external width of the housing 22 in the direction of the formed channels 24 may be such that the first and second mating ends 14 of conductive contact member 12 are disposed internally within the channels (FIGS. 1A, 1B and 1C), flush with the external openings of the channels 24, partially external to channels 24, or totally external of the channels 24, depending upon the electrical integration application. The height of the channels 24 is such that outer surfaces of the arcuate arms 34 engage top and bottom surfaces of each channel 24 in a freely rotatable manner. Further, the height of each channel 24 must be such that a corresponding surface of the resilient central segment 18 engages either the top or bottom surfaces, alternatively, depending upon whether the conductive contact member 12 is in the first or second stable state, as shown in FIGS. 1B and 1C, respectively, in such a manner that the resilient central segment 18 is maintained in a stressed condition. The width of the channels 24 need only be slightly greater than the thickness of an individual conductive contact member 12.

First and second actuation means or slots 26 are formed transversely to the plurality of channels 24, and extend lengthwise through the housing 22 to side faces 25 thereof. In preferred embodiments, the actuation slots 26 are approximately circular in cross-section. The first and second actuation slots 26 form approximately hermispherical grooves in the top and bottom surfaces of the channels 24 at the intersection thereof, as shown in FIGS. 1A, 1B, and 1C.

In FIGS. 1A, 1B, and 1C the first and second actuation slots 26 are shown offset from the centers of segments 18 in a preferred embodiment. The offset relationship enables the segments 18 to flex in a preferred "S" shape as illustrated in FIG. 1A in transitioning between stable states. This reduces the actuation force as compared to transitioning through an "M" state which would occur in the case of central placement of the cylindrical grooves 26.

First and second retention means 28, shown in FIGS. 1A, 1B, and 1C, are rigidly disposed within each of the plurality of channels 24 of the housing 22 adapted to receive conductive contact members 12 having first and second C-shaped mating ends 14. The first and second retention means 28 comprise first and second convex segments, the convex cylindrical segments 28 formed so as to be complimentary to the concave surface segments 20 which function as the carrier engaging means for this embodiment. The carrier engaging means 20 of each C-shaped mating end 14 is freely rotatable about the corresponding convex segment 28. The first and second convex segments 28 are rigidly disposed within each channel 24 to define a distance d between the inward most surfaces thereof, as shown in FIG. 1C. The distance d is determined such that, when the first and second concave segments 20 of the C-shaped mating ends 14 of each conductive contact member 12 engage corresponding convex segments 28 within each channel 24, the resilient central segment 18 is maintained in a stressed condition in the first and second stable states. That is, distance d is slightly less than a distance $d_e$ as shown in FIG. 2A.

Fabrication of the housing 22 of this embodiment may be accomplished by any of the various methods known to those skilled in the art. For example, the housig 22 may be molded with preformed channels 24, first and second actuation slots 26, and first and second longitudinal dowel channels 29 (as shown in FIGS. 3A and 3B) extending lengthwise of the housing 22 and intersecting each channel 24 so that the facing surfaces of dowel channels 29 are spaced apart by distance d. The dowel channels 29 are adapted to receive dowel inserts 31, the dowel inserts 31 fabricated so that the interior facing portions thereof comprise the first and second convex segments 28. To mount conductive contact members 12 within corresponding channels 24, a first dowel 31 is inserted into the housing 22, after each conductive contact member 12 is inserted into a corresponding channel 24, the second dowel 31, which may have a tapered leading edge, is then inserted into the housing 22, the convex segments 28 thereof engaging the concave surfaces 20 of the other C-shaped mating ends 14.

Alternatively, the housing 22 may be formed as a solid block of insulating material, and the channels 24, first and second actuation slots 26 and the first and second dowel channels 29 bored therein. The housing 22 may be fabricated with a standard number of channels 24, and depending upon the electrical integration application each channel 24 will receive a conductive contact member 12 or be left empty. Alternatively, the housing 22 may be fabricated for particular electrical integration applications, in which case the housing 22 will have formed therein the minimum number of required channels 24.

Housings 22 adapted for the conductive contact member 12 configurations of FIGS. 2A and 2B are shown generally in FIGS. 4A, 4B, 4C and 4D. Each such housing 22 has a plurality of channels 24 formed therethrough transversely to the longitudinal axis thereof, and first and second actuation means or slots 26 are formed transversely to the plurality of channels 24, the first and second actuation slots 26 extending lengthwise through the housing 22 to side faces 25 thereof. As in the previously described embodiment, the first and second actuation slots 26, where they intersect each channel 24, form grooves in top and bottom surfaces thereof.

Figure 4B:
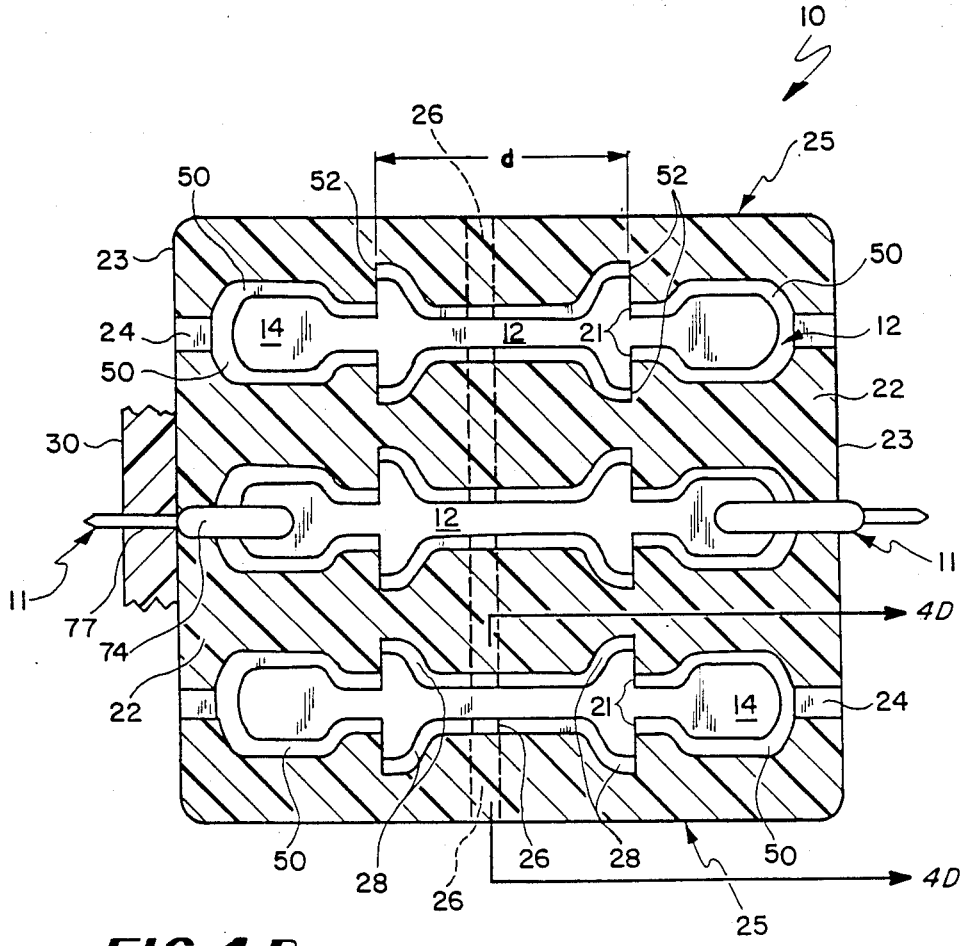
FIG. 4B is a cross-sectional view of the housing of FIG. 4A taken along 4B—4B.
Figure 4C:
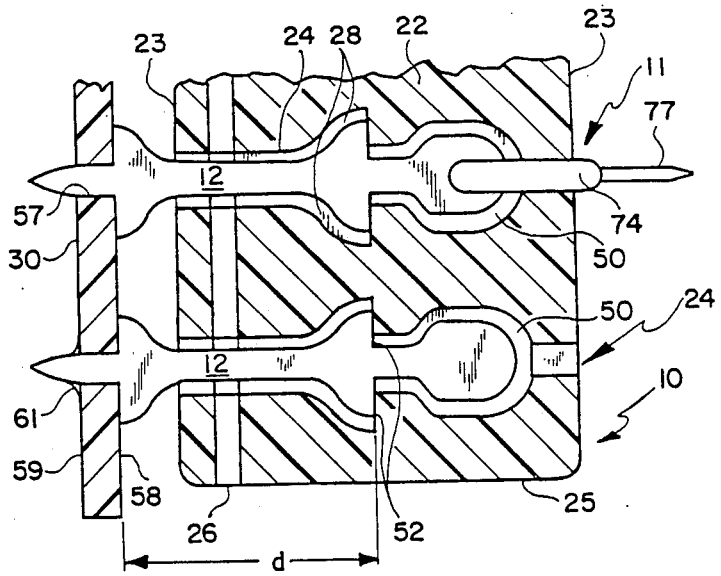
FIG. 4C is a cross-sectional view similar to FIG. 4B, but illustrating an insulated housing for the conductive contact member of FIG. 2C.
Figure 4D:
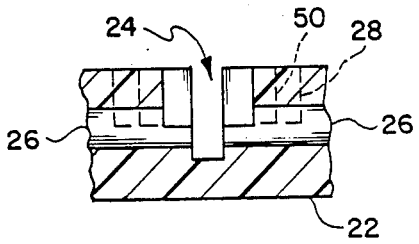
FIG. 4D is a cross-sectional view of the housing of FIG. 4B taken along line 4D—4D.

As shown in FIGS. 4A, 4B and 4C, each channel 24 further includes at least one chamber 50 formed internally and spaced apart from or opening onto end faces 23 of the housing 22. Chamber 50 is adapted to receive the at least one generally rectangular, flat mating end 14 of the conductive contact members 12 of FIGS. 2B and 2C. The housing 22 of FIG. 4C has one set of chambers 50 internally, spaced apart from an end face 23, in each channel 24 thereof to receive each singular generally rectangular, flat mating end 14 of the conductive contact member 12 of FIG. 2C. The singular generally rectangular, flat mating end 14 is thus disposed internally of the adjacent end face 23. Alternatively, the chamber 50 may be formed such that singular generally rectangular, flat mating end 14 is disposed to lie partially outside the channel 24, or the chamber 50 is eliminated entirely wherein the generally rectangular, flat mating end 14 is disposed external to the end face 23.

The housing 22 depicted in FIG. 4B includes a pair of chambers 50 formed at or near each end of each channel 24 to receive first and second generally rectangular, flat mating ends 14, respectively, of the conductive contact member of FIG. 2B. FIG. 4B depicts the chambers 50 formed internally of end faces 23. Each pair of chambers 50 may be formed such that the first and second generally rectangular, flat mating ends 14 are disposed to lie partially outside the channel 24.

Alternatively, the channels 24 may be formed without chambers 50 such that one or both generally rectangular, flat mating ends 14 are disposed entirely external to the channels 24.

The retention means 28 for housings 22 adapted to receive conductive contact members 12 having carrier engaging means 20 comprising dual pairs of tabs includes one pair of first and second pairs of notches or recesses formed in sidewalls of the channels 24 as shown in FIGS. 4B and 4C. The notches or recesses 28 of each pair are formed in opposed relationship in the sidewalls of the channels 24 and are adapted to receive the tabs 20 of the conductive contact member 12. Each pair of notches or recesses 28 has a planar wall 52 generally perpendicular to the axis of the channel 24 and disposed proximal to the end face or faces 23 of the housing 22. The planar walls 52 of each pair of notches or recesses 28 are adapted to engage the leading edges 21 of each pair of tabs 20, as shown in FIGS. 2B and 2C, leading edge as herein used being understood to mean those edges 21 of the tabs 20 in closest proximity to the mating ends 14 thereof. As shown in FIG. 2C the leading edges 21 and 21' of the first and second pairs of tabs 20 are separated by a distance $d_t$.

The housings 22 as shown in FIG. 4B include first and second pairs of notches or recesses 28 formed in each channel 24. The planar walls 52 of the first and second pairs of notches or recesses 28 are separated by a distance d. Distance d is selected to be slightly less than distance $d_t$ such that when a conductive contact member 12 according to FIG. 2B is disposed within the corresponding channel 24 of the housing 22 of FIG. 4B the conductive contact member 12, by means of resilient central segment 18, is maintained in a stressed condition in either the first or second stable state by engagement of the leading edges 21 of the first and second pairs of tabs 20 with the corresponding planar walls 52 of the first and second pairs of notches or recesses 28, respectively.

The housing 22 as shown in FIG. 4C is adapted to receive a conductive contact member 12 as shown in FIG. 2C. The housing 22 therefore has only a single pair of notches or recesses 28 formed in each channel 24. The non-adapted mating end 14 of this conductive contact member 12, by means of the elongated section 42 having a free tapered end 44, is inserted into a complimentary receptacle element of an electrical/electronic device 30. As shown in FIG. 4C the non-adapted mating end 14 is inserted into a hole (complimentary receptacle) 57 of a PC board 30. A solder joint 61 on a surface 59 of the PC board 30 distal the housing 22 securely engages the non-adapted mating end 14 to the PC board 30. This engagement is accomplished in a manner such that another surface 58 proximal to the housing 22 is maintained at distance d from the planar walls 52 of the pair of notches or recesses 28 formed in each channel 24. This ensures that each conductive contact member 12, by means of resilient central segment 18, is maintained in a stressed condition in the first and second stable states since the distance $d_t$ between the leading edges 21, 21' of each pair of tabs 20 is slightly greater than the distance d.

The housing 22 of this embodiment is readily and inexpensively fabricated by those skilled in the art. By way of example, the housing 22 may be molded from an insulating material as mirror-image halves about a plane separating the top and bottom walls of the channels 24, having preformed channels 24, first and second actuation grooves 26, a single pair or first and second pairs of notches or recesses 28 per channel 24, and none, one or two chambers 50 per channel 24, as dictated by particular electrical integration requirements. Conductive contact members 12 may then be disposed in one half of the carrier member 22 such that the leading edges 21' of the tabs 20 engage the planar walls 52 of the notches or recesses 28. The mirror-image halves of the member 22 are then secured together by conventional means.

Figure 6:
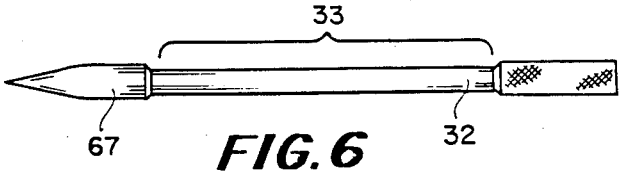
FIG. 6 illustrates a variable mass engagement means.
Figure 7:
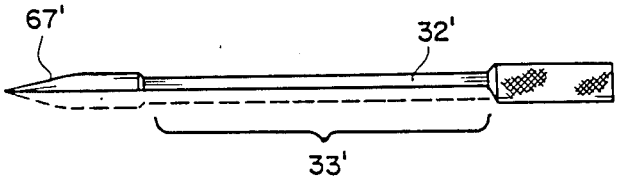
FIG. 7 is a sectional view of a flat or bar shaped contact actuation element.

A mass engagement means 32 shown in FIG. 6 cooperates with the first and second actuation slots 26 to engage the resilient central segments 18 of conductive contact members 12 disposed in the plurality of channels 24 to displace the conductive contact members 12 to the first and second stable states, respectively. Since in the preferred embodiments of the present invention the first and second actuation slots 26 are circular in cross-section, the mass termination means 32 comprises an elongated cylindrical rod adapted to be inserted into and removed from the slots 26, as shown in FIG. 6. The length of the elongated cylindrical rod 32 is sufficient so that all conductive contact members 12 disposed in a given plane of a plurality of channels 24 can be sequentially engaged and displaced, or mass terminated between the first and second stable states. An end 67 of the elongated cylindrical rod 32 is tapered, the degree of taper of the end 67 being determinative as to the number of conductive contact members 12 which are simultaneously engaged and displaced. The rod 32 is narrowed in a central portion 33 to a waist slightly less than the diameter of holes 26 to reduce friction. Alternatively, an actuation bar 32', shown in FIG. 7, may be used. Bar 32' comprises in effect a thin slice of rod 32, with the lower portion 33' eliminated.

A bistable ZIF connector assembly 10 is preloaded by disposing conductive contact members 12 in corresponding channels 24 of the housing 22. Carrier engaging means 20 of each conductive contact member 12 engage the interaction means 28 in a random manner such that the array of loaded conductive contact members 12 are randomly arranged in the first and second stable states. Prior to mass engagement between the conductive contact members 12 and the terminal connecting elements 11 of a plurality of devices 30, the mass engagement means 32 engages those conductive contact members 12 in the second stable state and displace such members 12 to the first or unengaged stable state.

In the first stable state, the openings 38, in the horizontal plane, of the C-shaped mating ends 14 of the conductive contact elements 12 of FIG. 2A are maximized, i.e., first and second mating surfaces 16 are maximally displaced apart from each other. With the mating surfaces 16 so disposed, the edge of a PC board 30 or a flexible circuit device 30 can be positioned in mating proximity between first and second mating surfaces 16 with zero force, that is, the first and second mating surfaces 16 are sufficiently displaced apart so that when the edge of the PC board 30 or the flexible circuit device 30 is positioned therebetween there is no contact between the upper and lower surfaces of the board or device 30 and the first and second mating surfaces 16. Mass engagement is then effected by the means 32 cooperating with the other activation means 26 to sequentially engage one or more of the resilienhen effected by the means 32 cooperating with the other activation means 26 to sequentially engage one or more of the resilient central segments 18 of the conductive contact members 12. The mass engagement force exerted on resilient central segments 18 displaces the conductive contact members 12 to the second stable state. Since the configuration of the mass engagement means determines the number of conductive contact members 12 which will be mass engaged, varying the configuration of the mass engagement means 32 controls the level of force required for mass engagement.

The first and second mating surfaces 16 in the second stable state are minimally displaced apart from each other along the horizontal plane. This results in a reduction of the opening 38 such that each mating surface 16 contacts the terminal contact element 11, such as a conducting strip or individual contact points, on a corresponding surface of the PC board or flexible circuit device 30 and exerts a substantially normal contact force thereagainst. Since the contact forces exerted by the first and second mating surfaces 16 act in opposed directions on the corresponding surfaces of the PC board or flexible circuit device 30, the PC board or flexible circuit device 30 is maintained in secured engagement between the first and second mating surfaces 16 subsequent to mass termination. The contact forces exerted by the first and second mating surfaces 16 result from the stressed condition of the resilient central segment 18.

During the transition from the first to the second stable state the contact force between the first and second mating surfaces 16 and the contact surfaces of the terminal contact element integrally increases and effects a wiping engagement therebetween. Wiping engagement prior to the secured engagement of the second stable state enhances the electrical contact between the surfaces by contact cleaning.

Figure 5A:
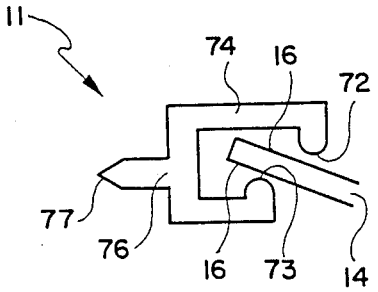
FIG. 5A is a side view of a terminal connecting element and generally rectangular, flat mating end in a first stable state.
Figure 5B:
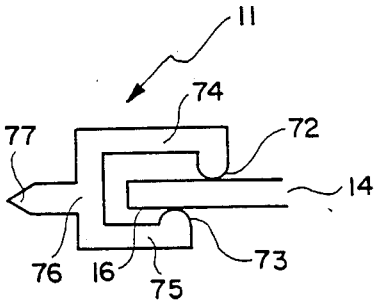
FIG. 5B is a side view of the elements of FIG. 5A in a second stable state.

The generally rectangular, flat mating ends 14 of the conductive contact members 12 of FIGS. 2C or 2B are maintained in a slighly skewed position in the first stable state, as shown in FIG. 5A. In this skewed position each mating end 14 can be positioned in mating proximity between contact surfaces or points 72, 73 of the terminal contact element 11 shown in FIG. 5A with zero force and zero contact. The terminal contact element 11 of FIGS. 5A and 5B is a female connector including spaced apart parallel arms 74, 75, having contact surfaces or points 72, 73, respectively, disposed thereon in facing relation, a body 76 joining the arms 74, 75 and a mounting tab 77 extending from the body 76 for mounting this terminal contact element 11, as for example to a PC board 30. The skew of the mating end 14 is such that it is insertable between the contact surfaces or points 72, 73 without any contact therebetween. Mass engagement is then effected by causing the mass engagement means 32 to cooperate with the other actuation means 26 to engage the resilient central segments 18 of the conductive contact members 12. A mass engagment force displaces the conductive contact members 12 to the second stable state.

The first and second mating surfaces 16 of each mating end 14 in the second stable state contact the contact surfaces or points 72, 73 of the terminal contact element 11 and exert a substantially normal contact force thereagainst. To ensure such contact the vertical distance between the parallel planes encompassing the contact surfces or points 72, 73 must be slightly less than a thickness t of each generally rectangular, flat mating end 14. Since the contact forces exerted by the first and second mating surfaces 16 act in opposed directions against the contact surfaces or points 72, 73, respectively, each mating end 14 is maintained in secured engagement between the contact surfaces or points 72, 73 of the terminal contact element 11. The contact forces exerted by the first and second mating surfaces 16 result from the stressed condition of the resilient central segment 18. And, in the manner discussed above, the contact surfaces 16 wipingly engage the contact surfaces or points 72, 73 prior to achieving secured engagement in the second stable state.

Figure 8:
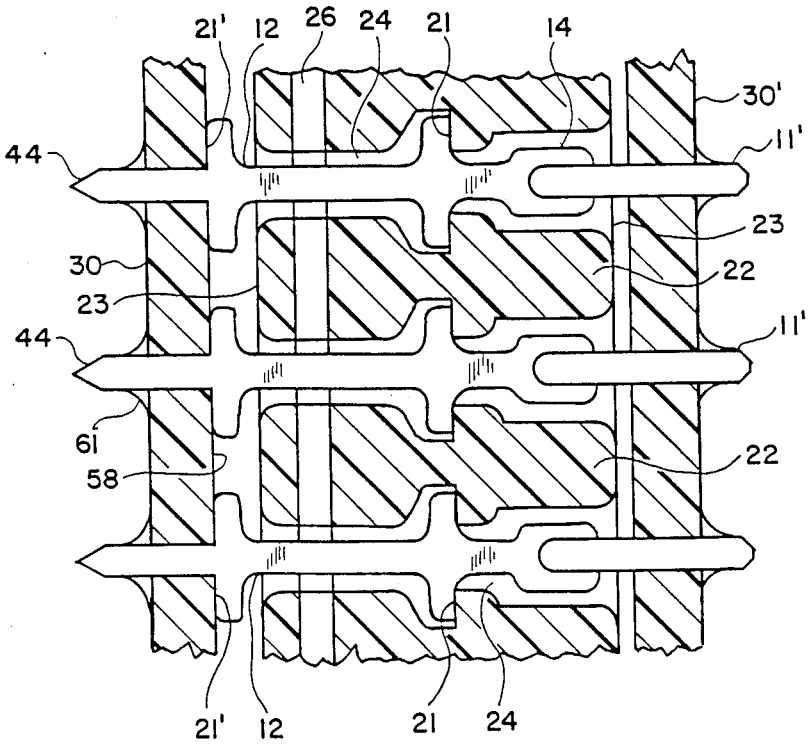
FIG. 8 is a sectional view of a further embodiment.

With reference to FIG. 8 there is shown a further modification of the contact system of the present invention as specifically illustrated above with respect to FIGS. 4B and 4C. In particular a set of contacts 12 are fixed in a printed circuit board 30 and soldered at fillets 61. The contacts 12' have a central spring portion 18 providing the bistable function against the leading edges 21, 21' which respectively contact the carrier member 22 and the board 30. The contacts 12 are operative to make connection between the board 30 and a second board 30' through pins 11' in the board 30'. The pins 11' may be of the type having a U or C shape connecting portion 74 as illustrated above with respect to FIGS. 5A and 5B and make contact with a portion 14 of the contacts 12 adjacent the board 30'. This architecture is valuable for connecting arrays of one or more master boards 30 and 30', particularly common in the environment of high density microprocessor or parallel processor circuitry.

Figure 9A:
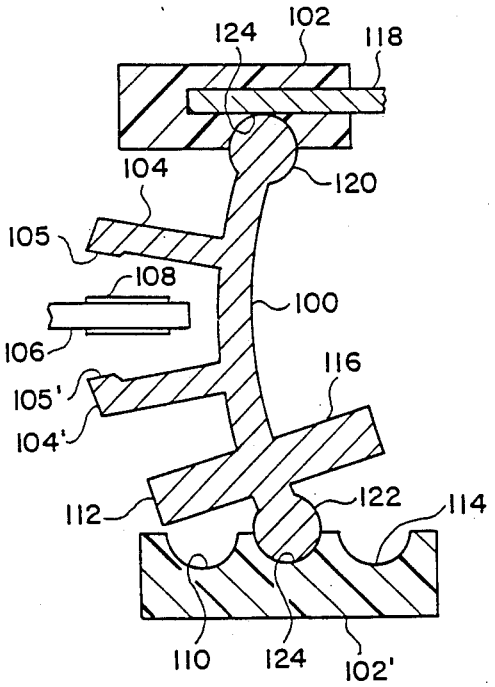
FIGS. 9A and 9B are sectional views of a further embodiment showing a push actuatable stable contact assembly.
Figure 9B:
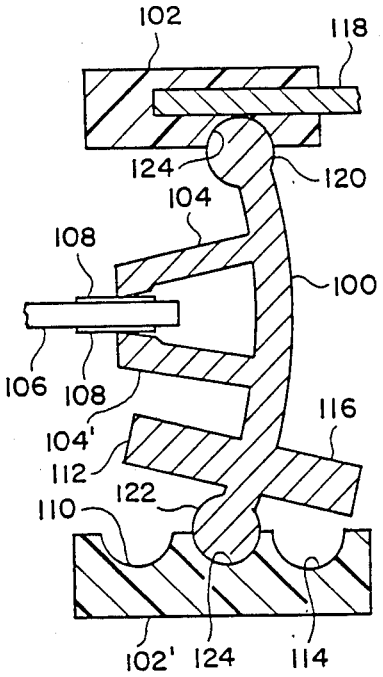

With respect now to FIGS. 9A and 9B a further embodiment of a bistable contact, in first and second stages respectively, is illustrated. The contact of FIGS. 9A and 9B comprises a central arcuate portion 100 which is compressed between upper and lower portions 102 and 102' of a casing so as to spring load the actuate portion 100 into one or the other of the stable states illustrated in FIGS. 9A and 9B. A pair of contact arms 104 and 104' extend leftward in the view of FIGS. 9A and 9B and are biased respectively open and closed in the two configurations. The contact arms 104, 104' have raised contact segments 105, 105', respectively, disposed at the external ends thereof in a facing relationship as shown in FIG. 9A. The facing surfaces of contact segments 105, 105' constitute the contact surfaces of the contact arms 104, 104'.

In the open configuration of FIG. 9A, the arms 104 and 104' permit a printed circuit board 106 having contacts 108 thereon to be inserted between them with zero force/zero contact. The inner portion of the board 106 can be used as the engagement means to effect the transition from the stable state of FIG. 9A to the stable state of FIG. 9B by pressing inwardly, with or without an extension, upon the actuate portion 100, forcing the actuate portion 100 to assume the other stable state illustrated in FIG. 9B wherein the arm 104 and 104' are snapped inwardly to securedly engage the contact surfaces thereof with the contacts 108 of the board 106. Alternatively, an engagement means may be inserted in groove 110 in order to switch the bistable actuate portion 100 between the states of FIG. 9A and FIG. 9B by bearing against a triggering tab portion 112 which extends laterally from a bottom portion of the actuate member 100. Similarly the actuate member 100 can be switched between the state of FIG. 9B and the state of FIG. 9A by use of a rod or bar inserted in the groove 114 of casing 102' in bearing against the extension portion 116 extending laterally, opposite from the portion 112 at the base of the actuate member 100.

The upper casing 102 is shown in the views of FIG. 9A and FIG. 9B to include an imbedded or inserted contact member 118 which bears against an upper rotary, ball or cylindrical member 120 on the upper extension of the actuate member 100 to provide electrical contact therefrom to the member 118. A lower ball or cylindrical portion 122 is similarly provided at base of the actuate member 100. The balls or cylinders 120 and 122 ride within channels or depressions 124 in the casings 102 and 102'.

Figure 10A:
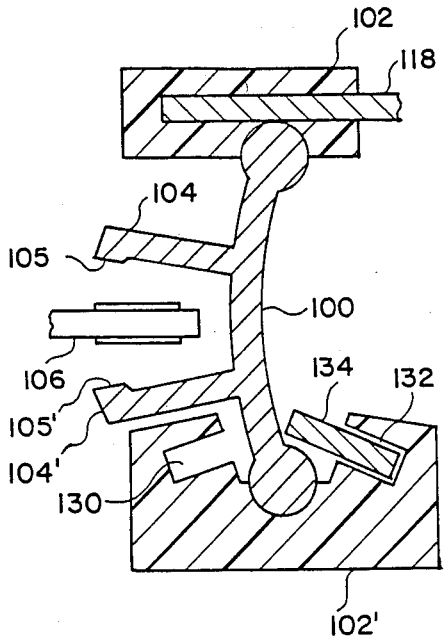
FIGS. 10A and 10B are sectional views of the contact assembly of FIGS. 9A and 9B showing an alternative release mechanism.
Figure 10B:
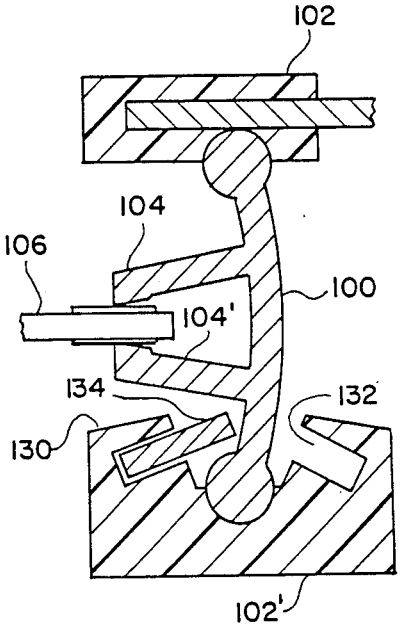

In the view of FIGS. 10A and 10B there is shown a modified embodiment of the contact assembly of FIGS. 9A and 9B wherein the casing member 102', instead of having grooves 110 and 114, contains slots 130 and 132 in which a bar 134 having a tapered leading edge, can be inserted down the bank of contacts in the contact assembly to provide progressive or serial actuation of the connector assembly from or between a connected and unconnected state respectively.

Figure 11:
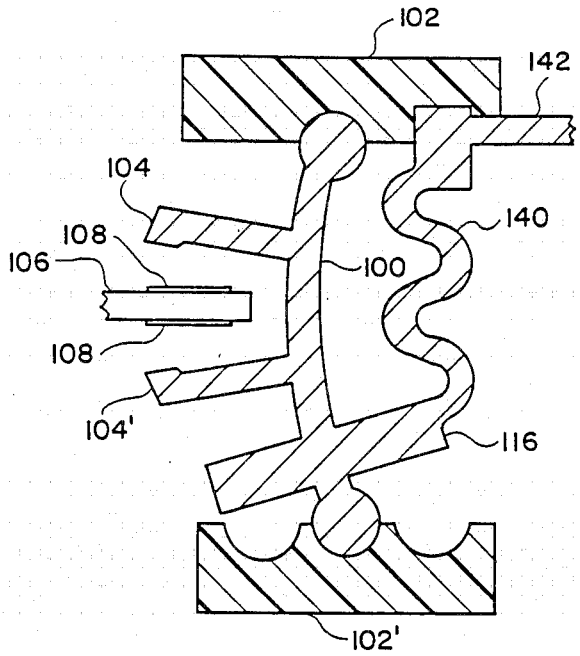
FIG. 11 is a sectional view of a further modification to the contact set of FIGS. 9A and 9B having an auxiliary spring to maintain contact pressure.

In FIG. 11 there is shown an embodiment modified over that illustrated with respect to FIGS. 9A and 9B and in which electrical contact to the actuate member 100 and correspondingly to the contact arms 104 and 104' is accomplished through a serpentine spring member 140 which makes contact between a lateral member 116 and a connector 142 affixed to the casing 102. The spring member 140 provides a spring effect slightly weaker than that provided by the spring loaded bistable actuate member 100 and therefore permits bistable operation of the actuate member 100 but provides, in addition to electrical contact directly thereto, an auxiliary force maintaining the actuate member 100 in the stable state wherein the contact surfaces of the contact arms 104 and 104' are urged against the contacts 108 of the circuit board 106.

Figure 12:
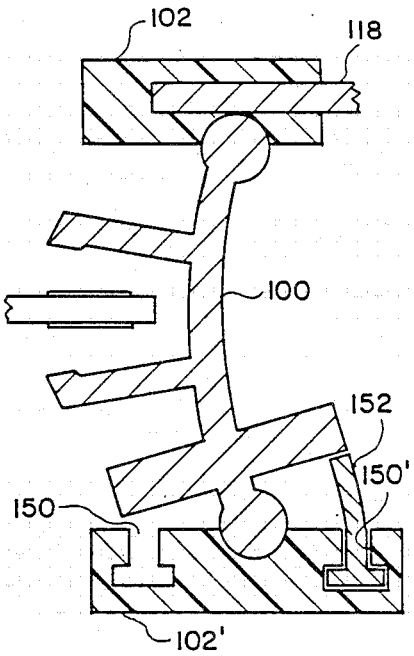
FIG. 12 is a sectional view of a modified switching mechanism of the contact set of FIGS. 9A and 9B.

In FIG. 12 there is shown a yet further embodiment of the contact assembly illustrated in FIGS. 9A and 9B. In this example T-cross sectional shaped grooves 150 and 150' are provided in which a triggering tool 152, having a tapered leading edge for serial actuation of the contacts, is inserted. The T-shaped cross section securely positions the triggering member 152 over the entire length of the groove passage 150 and 150' which is of value in contact assemblies running substantial distances in the direction into the page.

The embodiments of FIGS. 9A, 9B, 10A, 10B, 11, and 12, in addition to stable contact positions which provide secure open and closed contact states, also provides a wiping action between the contact surfaces of the contact arms 104 and 104' on the one hand and the printed circuit board contacts 108 on the other hand, facilitating good electrical contact with each actuation of the contact assembly.

Figure 13:
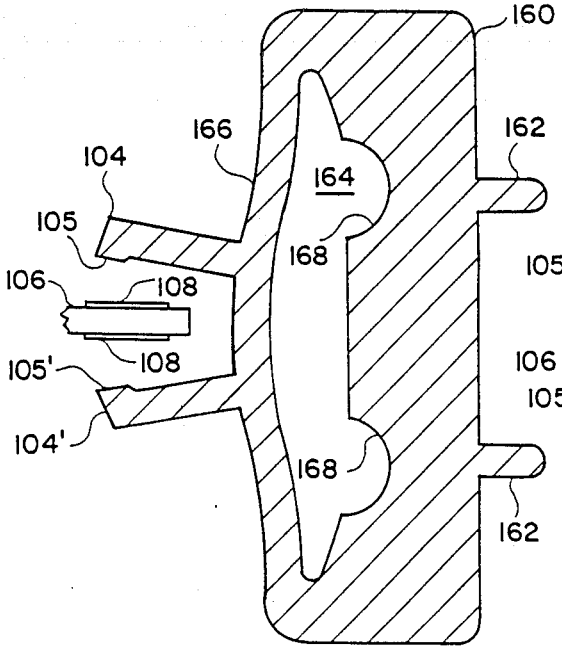
FIG. 13 is a sectional view of a further embodiment of a bistable contact set mechanism.
Figure 14:
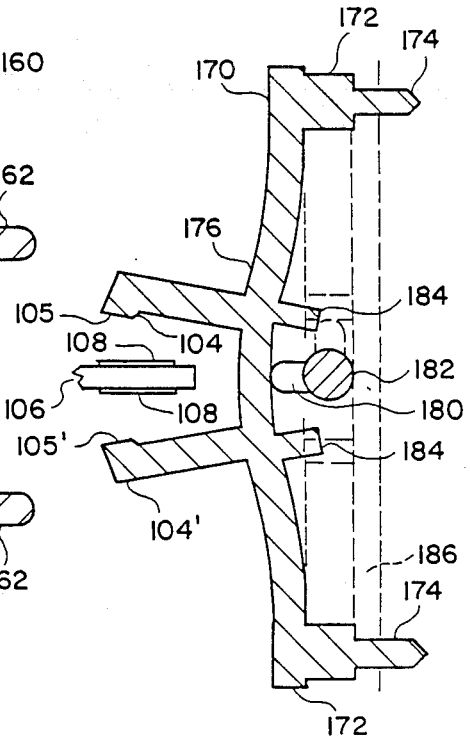
FIG. 14 is a sectional view of a modification to the contact set mechanism of FIG. 13.

FIGS. 13 and 14 illustrate a further embodiment of the invention, particularly suitable for manufacturer by stamping. In the embodiment of FIG. 13 a plate 160 is provided having electrical contacts 162 which may be soldered or otherwise affixed into electrical contact with plating on a printed circuit board. The plate 160 is stamped to provide an aperture 164 which has an outer actuate portion 166 with contact arms 104 and 104' extending outwardly therefrom. The contact arms 104, 104' have raised contact segments 105, 105', respectively, disposed at the external ends thereof in a facing relationship as shown in FIG. 13. The facing surfaces of contact segments 105, 105' constitute the contact surfaces of the contact arms 104, 104'. The aperture 164 includes groove portions 168 in which an actuation tool may be placed to switch the actuate member 166 into the configuration illustrated in the figure. The actuate member 166 is provided with a prestressed compression which imparts two stable states, the first being that shown and the second being achieved by triggering it, with an inward push of circuit board 106, which causes it to transition to its second stable state bringing the contact surfaces of the contact arms 104 an 104' into electrical connection with contacts 108 on the printed circuit board 106. The compressed state of the actuate member 166 is accomplished during manufacture by either stretching the member 166 to the plastic yield state causing it to assume a length greater than its original length and thereby providing the stable states, or by plastically compressing the end portions of the plate 160 where the actuate member 166 joins it. The actuate member 166 is switched from its second to its first stable state by use of one or more actuating tools in the grooves 168, substantially of the type illustrated above with respect to FIG. 6.

With respect to FIG. 14 a further embodiment is illustrated in which a plate 170 has electrically conducting standoff portions 172 extending rightward therefrom and terminating in connector pins 174 which may be placed into a printed circuit board for electrical connection to plating thereon. The plate member 170 is slit to separate from the body of the plate 170 an actuate member 176 which is plastically elongated to cause it to exhibit a bistable condition having a first state illustrated in FIG. 14 and a second state in which it is switched rightward in the view of FIG. 14 to assume a similarly arcuate, inverted curve. The member 176 has contact arms 104 and 104' of similar configuration as the embodiment of FIG. 13 which, in the second state, not illustrated, are caused to contact the contacts 108 of printed circuit board 106. Pushing on the printed circuit board 106 causes the actuate member 176 to transition from its first to second stable state. The transition between the second and the first state may be caused by a cam 180 on a shaft 182 which rides between the guide arms 184 attached to the main body of the plate 170, and printed circuit board 186 to which the terminals 174 are affixed. Plural cams 180 along the shaft 182 may be affixed at different angles or phases about the shaft 182 to provide sequential or progressive actuation of the actuate member 176 by shaft rotation. The transition between the stable states of member 176 may alternatively be accomplished with a rod of the type shown in FIG. 6 and tab portions similar to portions 112 and 116 in FIGS. 9A and 9B along with grooved supports such as carriers 104'.

The embodiments of both FIGS. 13 and 14 not only stable contact states but a wiping contact action in providing electrical connection between the arms 104 and 104' on the one hand and contacts 108 on the printed circuit board 106. A particular advantage of the embodiments of FIGS. 13 and 14 is that the actuate members (166, 176) do not require a housing or casing to be maintained in the first and second stable states.

Obviously, numerous modifications and variations of the present invention are possible in light of the above teachings. It is therefore to be understood that within the scope of the appended claims, the present invention may be practiced otherwise than as specifically described herein.

I claim:

1. A bistable zero insertion force contact assembly for electrical interconnection of a plurality of first contacts to a plurality of corresponding second contacts, comprising:

a plurality of first contacts adapted to mate with a plurality of corresponding second contacts;

means for establishing first and second stable states in said plurality of first contacts with a region of unstable states therebetween, said establishing means further comprising:

means external of said plurality of first contacts for progressively engaging said plurality of first contacts to cause said plurality of first contacts to be displaced between said first and second stable states; and resilient means integral with said plurality of first contacts for transitioning said plurality of first contacts between said first and second stable states and for maintaining said plurality of first contacts in either said first and second stable states without force imparted by said engaging means;

said first state imparting a low insertion force mating between said plurality of first contacts and the plurality of corresponding second contacts; and said second state imparting forced contact between said plurality of first contacts and the plurality of corresponding second contacts for electrical interconnection therebetween.

2. The assembly of claim 1 wherein said plurality of first contacts are of one type selected from the group consisting of male and female contacts and the plurality of corresponding second contacts are of the other type.

3. The assembly of claim 1 wherein transition of said plurality of first contacts through said region of unstable states causes said plurality of first contacts to exert wiping contact against the plurality of corresponding second contacts.

4. The assembly of claim 1 further including a carrier for housing said plurality of first contacts and for positioning said plurality of first contacts for low insertion force mating with the plurality of corresponding second contacts.

5. The assembly of claim 1 wherein said plurality of first contacts are female contacts and said resilient means of said establishing means transitions said plurality of first contacts between an open state and a closed state.

6. The assembly of claim 5 wherein said resilient means of said establishing means is under stress in said first and second states wherein said plurality of first contacts are maintained in said first and second states until acted upon by said engagement means.

7. The assembly of claim 1 wherein the plurality of corresponding second contacts further comprise at least one printed circuit board having a plurality of terminal contacts corresponding to said plurality of first contacts.

8. The assembly of claim 1 wherein said resilient means of said establishing means further comprises stressed means integral with said plurality of first contacts.

9. A bistable zero insertion force contact assembly for mating with a plurality of corresponding second contacts, comprising:

a plurality of first contacts adapted to mate with a plurality of corresponding second contacts;

means for establishing first and second stable states in said first contacts with a region of unstable states therebetween, said establishing means further comprising stressed means and wherein said stressed means further comprises arcuate stressed means in said first and second stable states, and wherein said stressed means exhibits an S-shaped form in said region of unstable states;

said first state imparting a low insertion force mating between said plurality of first contacts and the plurality of corresponding second contacts; and said second state imparting forced contact between said plurality of first contacts and the plurality of corresponding second contacts.

10. A bistable zero insertion force contact assembly for electrical interconnection of a plurality of first contacts to a plurality of corresponding second mating contacts, comprising:

a plurality of first mating contacts for electrical interconnection with a plurality of corresponding second mating contacts;

means for establishing first and second states in said plurality of first mating contacts, said establishing means further comprising:

means external of said plurality of first mating contacts for progressively engaging said plurality of first mating contacts to cause said plurality of first mating contacts to be displaced between said first and second states, and resilient means integral with said plurality of first contacts for transitioning said plurality of first mating contacts between said first and second states and for maintaining said plurality of first contacts in either of said first and second stable states until acted upon by and without force from said engaging means;

said first state imparting a low insertion force mating between said plurality of first mating contacts and the plurality of corresponding second mating contacts;

said second state imparting forced contact between said plurality of first mating contacts and the plurality of corresponding second mating contacts; and wherein said engaging means includes means for progressively changing the state of said plurality of first mating contacts between said first and second states,

11. The assembly of claim 10 wherein said plurality of first mating contacts are of one type selected from the group consisting of male and female contacts and the plurality of corresponding second mating contacts are of the other type.

12. The assembly of claim 10 further including a carrier for housing said plurality of first mating contacts and for positioning said plurality of first contacts for low insertion force mating with the plurality of corresponding second mating contacts.

13. The assembly of claim 10 wherein said means for progressively changing includes a cam surface.

14. The assembly of claim 13 wherein said means for progressively changing is an elongate tool and further wherein said cam surface is a tapered end of said elongate tool.

15. The assembly of claim 13 wherein said means for progressively changing is an elongate tool and further wherein said cam surface is a plurality of cams distributed along said elongate tool.

16. The assembly of claim 15 wherein said plurality of cams are phased with respect to each other.

17. The assembly of claim 10 wherein the plurality of corresponding second mating contacts further comprises at least one printed circuit board having a plurality of terminal contacts corresponding to said plurality of first mating contacts.

18. The assembly of claim 10 wherein said resilient means of said establishing means further comprises stressed means integral with said plurality of first mating contacts.

19. The assembly of claim 10 further including a region of unstable states between said first and second stable states and wherein transition of said plurality of first mating contacts in said region of unstable states causes said plurality of first mating contacts to exert wiping contact against the plurality of corresponding second mating contacts.

20. A bistable zero insertion force contact assembly comprising:

a plurality of first and second mating contacts;

means for establishing first and second states in one of said plurality of first and second mating contacts, said means for establishing first and second states further comprising stressed means and wherein said stressed means further comprises arcuate stressed means in said first and second states, and wherein said stressed means exhibits an S-shaped form between said first state and said second state;

said first state imparting a low insertion force mating between said contacts;

said second state imparting forced contact between said plurality of first and second mating contacts; and means for progressively changing the state between said first and second states from one to the other of said plurality of first and second mating contacts.

21. A bistable zero insertion force connector assembly for electrically integrating devices, comprising:

a conductive contact member, said conductive contact member further comprising:

first and second mating ends, at least one of said first and second mating ends having at least one contact surface adapted for bistable connection with at least one of said devices, a resilient central segment integrally connecting said first and second mating ends, and carrier engaging means proximal said resilient central segment for inducing stress in said resilient central segment;

an insulated housing having:

a channel therethrough adapted to receive said conductive contact member in such manner that said first and second mating ends are disposed to be electrically integrated to said devices, actuation means adapted to cooperate with said reilient central segment to alternately displace said conductive contact member to first and second stable states;

interaction means cooperating with said carrier engaging means for inducing stress in said resilient central segment of said conductive contact member disposed in said channel in said first and second stable states, respectively, and wherein said conductive contact member is maintained in said first and second states due to a stressed condition induced therein, and wherein in said first stable state said first and second mating ends are disposed in mating proximity with at least one of said devices with zero force and zero contact, and in said second stable state said first and second mating ends are maintained in secured engagement with at least one of said devices by engaging forces therebetween; and engagement means adapted to cooperate with said actuation means, and wherein said engagement means cooperates with said actuation means to displace said conductive contact member to said first and second second stable states, respectively;

said conductive contact member remaining in said first and second stable states without force from said engagement means.

22. The bistable zero insertion force connector assembly according to claim 21, wherein each of said first and second mating ends include first and second contact surfaces adapted for bistable connection with said devices.

23. The bistable zero insertion force connector assembly according to claim 21, wherein said actuation means further comprise first and second grooves formed in opposed walls of said insulated housing and wherein said first and second grooves are proximally disposed adjacent said resilient central segment of said conductive contact member disposed in said channel.

24. A bistable zero insertion force connector assembly, for electrically integrating devices, comprising:

a conductive contact member, said conductive contact member further comprising:

first and second mating ends, at least one of said first and second mating ends having at least one contact surface adapted for bistable connection with at least one of said devices, each of said first and second mating ends including first and second contact surfaces adapted for bistable connection with said devices and wherein said first and second mating ends further comprise C-shaped ends, each of said C-shaped ends having an opening formed by terminated ends of arcuate arms forming said C-shaped ends disposed for bistable connection with said devices, and wherein said first and second contact surfaces further comprise said terminated ends forming said opening, a resilient central segment, and carrier engaging means proximal said resilient central segment;

an insulated housing having:

a channel therethrough adapted to receive said conductive contact member in such manner that said first and second mating ends are disposed to be electrically integrated to said devices, actuation means adapted to cooperate with said resilient central segment to alternately displace said conductive contact member to first and second stable states, interaction means cooperating with said carrier engaging means to alternately maintain said conductive contact member disposed in said channel in said first and second stable states, respectively, in a stressed condition, and wherein in said first stable state said first and second mating ends are disposed in mating proximity with at least one of said devices with zero force and zero contact, and in said second stable state said first and second mating ends are maintained in secured engagement with at least one of said devices by engaging forces therebetween; and engagement means adapted to cooperate with said actuation means, and wherein said engagement means cooperates with said actuation means to displace said conductive contact member to said first and second second stable states, respectively.

25. The bistable zero insertion force connector assembly according to claim 24 wherein said carrier engaging means further comprises first and second concave surfaces formed by said arcuate arms, each of said first and second concave surfaces disposed facing said opening and in such manner as to be approximately symmetric about a longitudinal axis of said resilient central segment, and wherein said interaction means further comprises first and second convex segments situated in said channel engaging said first and second concave surfaces, respectively, whereby when said conductive contact member is alternately displaced to said first and second stable states, respectively, said first and second concave surfaces rotate about said first and second convex segments, respectively.

26. A bistable zero insertion force connector assembly for electrically integrating devices, comprising:

a conductive contact member, said conductive contact member further comprising:

first and second mating ends, at least one of said first and second mating ends having at least one contact surface adapted for bistable connection with at least one of said devices, each of said first and second mating ends including first and second contact surfaces adapted for bistable connection with said devices and wherein said first and second mating ends further comprise generally rectangular, flat ends, and wherein said first and second contact surfaces of each said first and second mating ends further comprise upper and lower parallel surfaces, respectively, of said generally rectangular, flat ends, a resilient central segment, and carrier engaging means proximal said resilient central segment;

an insulated housing having:

a channel therethrough adapted to receive said conductive contact member in such manner that said first and second mating ends are disposed to be electrically integrated to said devices, actuation means adapted to cooperate with said resilient central segment to alternately displace said conductive contact member to first and second stable states, interaction means cooperating with said carrier engaging means to alternately maintain said conductive contact member disposed in said channel in said first and second stable states, respectively, in a stressed condition, and wherein in said first stable state said first and second mating ends are disposed in mating proximity with at least one of said devices with zero force and zero contact, and in said second stable state said first and second mating ends are maintained in secured engagement with at least one of said devices by engaging forces therebetween; and engagement means adapted to cooperate with said actuation means, and wherein said engagement means cooperates with said actuation means to displace said conductive contact member to said first and second second stable states, respectively.

27. The bistable zero insertion force connector assembly according to claim 26, wherein said carrier engaging means further comprises first and second pairs of tabs disposed proximal said resilient central segment in opposed relationship, and wherein said interaction means further comprises first and second pairs of recesses situated in opposed walls of said channel in such manner that said first and second pairs of tabs are engagingly disposed in said first and second pairs of recesses, respectively, when said conductive contact member is disposed in said channeland wherein said tabs cooperate with said recess to maintain said conductive contact member in said first and second stable states, respectively, in said stressed condition.

28. The bistable zero insertion force connector assembly according to claim 26, wherein said upper and lower opposed surfaces have selectively plated areas thereon, said selectively plated areas situated to securely engage contact surfaces of said devices when said conductive contact member is in said second stable state.

29. A bistable zero insertion force connector assembly for electrically integrating devices, comprising:

a conductive contact member, said conductive contact member further comprising:

first and second mating ends, at least one of said first and second mating ends having at least one contact surface adapted for bistable connection with at least one of said devices, and wherein said first mating end further comprises a generally rectangular, flat end having first and second contact surfaces, said first and second contact surfaces further comprising upper and lower opposed surfaces, respectively, of said generally rectangular, flat end, and wherein said second mating end further comprises an elongated member having a tapered end adapted to cooperate with one of said devices, a resilient central segment, and carrier engaging means proximal said resilient central segment;

an insulated housing having:

a channel therethrough adapted to receive said conductive contact member in such manner that said first and second mating ends are disposed to be electrically integrated to said devices, actuation means adapted to cooperate with said resilient central segment to alternately displace said conductive contact member to first and second stable states, interaction means cooperating with said carrier engaging means to alternately maintain said conductive contact member disposed in said channel in said first and second stable states, respectively, in a stressed condition, and wherein in said first stable state said first and second mating ends are disposed in mating proximity with at least one of said devices with zero force and zero contact, and in said second stable state said first and second mating ends are maintained in secured engagement with at least one of said devices by engaging forces therebetween; and engagement means adapted to cooperate with said actuation means, and wherein said engagement means cooperates with said actuation means to displace said conductive contact member to said first and second second stable states, respectively.

30. A bistable zero insertion force connector assembly for electrically integrating devices, comprising:

a plurality of conductive contact members, each of said plurality of conductive contact members further comprising first and second mating ends, at least one of said first and second mating ends having at least one contact surface adapted for bistable connection with at least one group of said devices, each of said first and second mating ends of said plurality of conductive contact members including first and second contact surfaces adapted for bistable connection with said devices, and wherein each of said first and second mating ends of said plurality of conductive contact members further comprise C-shaped ends, each of said C-shaped ends having an opening formed by terminated ends of arcuate arms forming said C-shaped ends disposed for bistable connection with said devices, and wherein said first and second contact surfaces further comprise said terminated ends forming said opening, a resilient central segment, and engaging means proximal said resilient central segment;

an insulated housing having:

a plurality of channels therethrough adapted to receive said plurality of conductive contact members in such manner that said first and second mating ends of said plurality of conductive contact members are disposed to be electrically integrated to said devices.

actuation means associated with said housing and adapted to cooperate with said resilient central segment of each said plurality of conductive contact members to alternately displace said plurality of conductive contact members to first and second stable states; and interaction means cooperating with said engaging means of said plurality of conductive contact members to alternately maintain said plurality of conductive contact members disposed in said plurality of channels in said first and second stable states, respectively, in a stressed condition, and wherein in said first stable state each said resilient central segment of said plurality of conductive contact members is disposed adjacent said actuation means and said first and second mating ends are disposed in mating proximity with said at least one group of said devices with zero force and zero contact, and in said second stable state each said resilient central segment of said plurality of conductive contact members is disposed adjacent said actuation means and said first and second mating ends are maintained in secured engagement with said first group of said devices due to engaging forces therebetween; and engagement means adapted to cooperate with said actuation means, wherein said engagement means cooperates with said actuation means to displace said plurality of conductive contact members to said second stable state, and said engagement means cooperates with said actuation means to displace said plurality of conductive contact members to said first stable state.

31. the bistable zero insertion force connector assembly according to claim 30, wherein said engaging means further comprises first and second concave surfaces formed by said arcuate arms of each said first and second mating ends, respectively, each of said first and second concave surfaces disposed facing said opening and in such manner as to be approximately symmetric about a central axis of each said resilient central segment; and wherein said interaction means further comprises:

first and second convex segments situated in each said plurality of channels engaging said first and second concave surfaces, respectively:

whereby when said plurality of conductive contact members are alternately is placed to said first and second stable states, respectively, each said first and second concave surfaces rotates about said first and second convex segments, respectively.

32. A bistable zero insertion force connector assembly for electrically integrating devices, comprising:

a plurality of conductive contact members, each of said plurality of conductive contact members further comprising first and second mating ends, at least one of said first and second mating ends having at least one contact surface adapted for bistable connection with at least one group of said devices, each of said first and second mating ends of said plurality of conductive contact members including first and second contact surfaces adapted for bistable connection with said devices, and wherein each of said first and second mating ends of said plurality of conductive contact further comprise generally rectangular, flat ends, and wherein said first and second contact surfaces of each said first and second mating ends further comprise upper and lower opposed surfaces, respectively, of said generally rectangular, flat ends, a resilient central segment, and engaging means proximal said resilient central segment;

an insulated housing having:

a plurality of channels therethrough adapted to receive said plurality of conductive contact members in such manner that said first and second mating ends of said plurality of conductive contact members are disposed to be electrically integrated to said devices, actuation means associated with said housing and adapted to cooperate with said resilient central segment of each said plurality of conductive contact members to alternately displace said plurality of conductive contact members to first and second stable states; and interaction means cooperating with said engaging means of said plurality of conductive contact members to alternately maintain said plurality of conductive contact members disposed in said plurality of channels in said first and second stable states, respectively, in a stressed condition, and wherein in said first stable state each said resilient central segment of said plurality of conductive contact members is disposed adjacent said actuation means and said first and second mating ends are disposed in mating proximity with said at least one group of said devices with zero force and zero contact, and in said second stable state each said resilient central segment of said plurality of conductive contact members is disposed adjacent said actuation means and said first and second mating ends are maintained in secured engagement with said first group of said devices due to engaging forces therebetween; and engagement means adapted to cooperate with said actuation means, wherein said engagement means cooperates with said actuation means to displace said plurality of conductive contact members to said second stable state, and said engagement means cooperates with said actuation means to displace said plurality of conductive contact members to said first stable state.

33. The bistable zero insertion force connector assembly according to claim 32, wherein said engaging means further comprises first and second pairs of tabs disposed proximal each said resilient central segment in opposed relationship, and wherein said interaction means further comprises:

first and second pairs of recesses situated in opposed walls of each said plurality of channels in such manner that each said first and second pairs of tabs are engagingly disposed in said first and second pairs of recesses, respectively, when said plurality of conductive contact members are disposed in said plurality of channels and wherein said tabs cooperate with said recess to maintain said plurality of conductive contact members in said first and second stable states, respectively, in said stressed condition.

34. A bistable zero insertion force connector assembly for electrically integrating devices, comprising:

a plurality of conductive contact members, each of said plurality of conductive contact members further comprising first and second mating ends, at least one of said first and second mating ends having at least one contact surface adapted for bistable connection with at least one group of said devices, and wherein each of said first mating ends further comprises a generally rectangular, flat end having first and second contact surfaces, said first and second contact surfaces further comprising upper and lower opposed surfaces, respectively, of said generally rectangular, flat end, and wherein each said second mating ends further comprises an elongated member having a tapered end adapted to cooperate ith another group of said devices, a resilient central segment, and engaging means proximal said resilient central segment;

an insulated housing having:

a plurality of channels therethrough adapted to receive said plurality of conductive contact members in such manner that said first and second mating ends of said plurality of conductive contact members are disposed to be electrically integrated to said devices, actuation means associated with said housing and adapted to cooperate with said resilient central segment of each said plurality of conductive contact members to alternately displace said plurality of conductive contact members to first and second stable states; and interaction means cooperating with said engaging means of said plurality of conductive contact members to alternately maintain said plurality of conductive contact members disposed in said plurality of channels in said first and second stable states, respectively, in a stressed condition, and wherein in said first stable state each said resilient central segment of said plurality of conductive contact members is disposed adjacent said actuation means and said first and second mating ends are disposed in mating proximity with said at least one group of said devices with zero force and zero contact, and in said second stable state each said resilient central segment of said plurality of conductive contact members is disposed adjacent said actuation means and said first and second mating ends are maintained in secured engagement with said first group of said devices due to engaging forces therebetween; and engagement means adapted to cooperate with said actuation means, wherein said engagement means cooperates with said actuation means to displace said plurality of conductive contact members to said second stable state, and said engagement means cooperates with said actuation means to displace said plurality of conductive contact members to said first stable state.

35. A bistable contact assembly comprising:

a plurality of resilient members;

first and second contact arms extending laterally from displaced positions on each said resilient member;

means for compressing said resilient members to cause them to exhibit first and second arcuate stable states in which said contact arms are respectively distant and proximate with respect to each other;

the proximate state of said contact arms being adapted to engage a contact.

36. The assembly of claim 35 wherein said compressing means include means for electrically contacting each said plurality of resilient members.

37. The assembly of claim 35 further including resilient means for causing one of said stable states to require a greater force to transition to the other than vice versa.

38. The assembly of claim 35 wherein said compressing means has a groove and means are provided operable in association with said groove to effect a transition between said stable states.

* * * * *

UNITED STATES PATENT AND TRADEMARK OFFICE

CERTIFICATE OF CORRECTION

PATENT NO. : 4,773,873

DATED : September 27, 1988

INVENTOR(S) : W. Daniel Hillis

It is certified that error appears in the above-identified patent and that said Letters Patent is hereby corrected as shown below:

In the Abstract

Last line, "enhance" should read --enhances--

Column 2, line 3, "throught" should read --through--

Column 6, line 34, "complimentary" should read --complementary--
line 53, "housig 22" should read --housing 22--

Column 7, line 40, "adjacent end" should read --adjacent exterior end--
line 62, "pair of first" should read --pair or first--

Column 8, lines 32-33, "com- plimentary" should read --com- plementary--
line 35, "(complimentary" should read --(complementary--
line 60, "edges 21' " should read --edges 21--

Column 9, lines 50-53, "the resilienhen effected by the means 32 cooperating with the other activation means 26 to sequentially engage one or more of the resilient" should read --the resilient--

Column 10, line 40, "engagment" should read --engagement--
line 49, "surfces" should read --surfaces--
line 68, "contacts 12' " should read --contacts 12--

Column 11, line 16, "stages" should read --states--
line 17, "arcuate" should read --actuate--
line 59, "at base" should read --at the base--

UNITED STATES PATENT AND TRADEMARK OFFICE

CERTIFICATE OF CORRECTION

PATENT NO. : 4,773,873

DATED : September 27, 1988

INVENTOR(S) : W. Daniel Hillis

It is certified that error appears in the above-identified patent and that said Letters Patent is hereby corrected as shown below:

| | | |
|---|---|---|
| Column 12, | line 39, | "manufacturer" should read --manufacture-- |
| | line 60, | "104 an" should read --104 and-- |
| Column 13, | line 24, | "the guide" should read --guide-- |
| | line 25, | "and" should read --and a-- |
| | line 36, | "14 not" should read --14 provide not-- |
| Column 15, | line 30, | "states," should read --states.-- |
| Column 16, | line 40, | "reilient" should read --resilient-- |
| Column 18, | line 65, | "channeland" should read --channel and-- |
| Column 20, | line 17, | "devices." should read --devices,-- |
| | line 52, | "31. the" should read --31. The-- |
| | line 67, | "is placed" should read --displaced-- |
| Column 22, | line 33, | "ith" should read --with-- |

Signed and Sealed this

Seventh Day of November, 1989

*Attest:*

JEFFREY M. SAMUELS

*Attesting Officer* *Acting Commissioner of Patents and Trademarks*